US010583963B2

(12) United States Patent
Su et al.

(10) Patent No.: US 10,583,963 B2
(45) Date of Patent: Mar. 10, 2020

(54) FOLDABLE CONTAINER

(71) Applicant: SHANGHAI HONGYAN RETURNABLE TRANSIT PACKAGINGS CO., LTD., Shanghai (CN)

(72) Inventors: Yongping Su, Shanghai (CN); Yuanli Jian, Shanghai (CN)

(73) Assignee: SHANGHAI HONGYAN RETURNABLE TRANSIT PAC KAGINGS CO., LTD., Shanghai (CN)

( * ) Notice: Subject to any disclaimer, the term of this patent is extended or adjusted under 35 U.S.C. 154(b) by 103 days.

(21) Appl. No.: 15/745,373

(22) PCT Filed: Jul. 11, 2016

(86) PCT No.: PCT/CN2016/089684
§ 371 (c)(1),
(2) Date: Jan. 16, 2018

(87) PCT Pub. No.: WO2017/008721
PCT Pub. Date: Jan. 19, 2017

(65) Prior Publication Data

US 2019/0092529 A1 Mar. 28, 2019

(30) Foreign Application Priority Data

Jul. 13, 2015 (CN) ..... 2015 1 0409691

(51) Int. Cl.
*B65D 25/54* (2006.01)
*B65D 25/24* (2006.01)
(Continued)

(52) U.S. Cl.
CPC ..... *B65D 25/24* (2013.01); *B65D 5/0045* (2013.01); *B65D 5/4204* (2013.01); *B65D 19/06* (2013.01);
(Continued)

(58) Field of Classification Search
CPC ..... B65D 25/24; B65D 25/00; B65D 25/54; B65D 5/0045; B65D 5/4204; B65D 2519/00129; B65D 2519/00273
(Continued)

(56) References Cited

U.S. PATENT DOCUMENTS 4,923,079 A * 5/1990 Foy ..... B65D 19/18 220/326
7,357,271 B2 * 4/2008 Hase ..... B65D 25/005 206/511
(Continued)

FOREIGN PATENT DOCUMENTS

CN 102758572 10/2012
CN 202717108 2/2013
(Continued)

OTHER PUBLICATIONS

International Search Report for international appl. No. PCT/CN2016/089684, dated Oct. 21, 2016 (4 pages, including English translation).
(Continued)

*Primary Examiner* — King M Chu
(74) *Attorney, Agent, or Firm* — Hamre, Schumann, Mueller & Larson, P.C.

(57) ABSTRACT

Disclosed is a foldable container (100), comprising a base (100), side plates (2,3) and a small door (31). The side plates are connected to the base (1). The small door (31) is arranged on the side plates. The small door (31) at least comprises a first part (312), wherein the width of the first part (312) gradually reduces from the upper end to the lower end, first meshing portions (315) are provided on the left end wall and the right wall of the first part (312), and first meshing structure (342) matching the first meshing portions (315) are provided on the side plates. When the container overall has a full load, the outward deformation of the small
(Continued)

door is small when the small door is extruded by goods, thereby saving on conveyance or stacking space of the container, and the reliability of stacking and conveyance is improved.

9 Claims, 18 Drawing Sheets

(51) Int. Cl.

| | |
|---|---|
| ***B65D 19/18*** | (2006.01) |
| ***B65D 19/06*** | (2006.01) |
| ***B65D 25/00*** | (2006.01) |
| ***B65D 5/00*** | (2006.01) |
| ***B65D 5/42*** | (2006.01) |

(52) U.S. Cl.
CPC ..... *B65D 19/18* (2013.01); *B65D 25/005* (2013.01); *B65D 25/54* (2013.01); *B65D 2519/009* (2013.01); *B65D 2519/00129* (2013.01); *B65D 2519/00273* (2013.01); *B65D 2519/00338* (2013.01); *B65D 2519/00422* (2013.01); *B65D 2519/00452* (2013.01); *B65D 2519/00502* (2013.01); *B65D 2519/00587* (2013.01); *B65D 2519/00646* (2013.01); *B65D 2519/00805* (2013.01)

(58) Field of Classification Search
USPC ..... 220/810
See application file for complete search history.

(56) References Cited

U.S. PATENT DOCUMENTS

| | | | | |
|---|---|---|---|---|
| 2005/0178770 | A1 | 8/2005 | Hase et al. | |
| 2013/0175265 | A1* | 7/2013 | Sommer ..... | B65D 11/1833 220/4.28 |

FOREIGN PATENT DOCUMENTS

| | | | |
|---|---|---|---|
| CN | 105035569 | | 11/2015 |
| DE | 102008004520 | A1 | 6/2009 |
| JP | H02242741 | A | 9/1990 |
| WO | 2010/031456 | | 3/2010 |
| WO | 2014186269 | | 5/2014 |
| WO | 2014186269 | A1 | 11/2014 |

OTHER PUBLICATIONS

The extended European search report issued in European patent application No. 16823868.1, dated Jul. 2, 2019.

* cited by examiner

B2

FOLDABLE CONTAINER

FIELD

The present invention relates to the field of logistics transportation, in particular to a foldable container.

BACKGROUND

The large container (folded or unfolded structure) according to the present invention is a kind of logistics box, whose volume is generally above 600 L, and is widely used in logistics transportation and warehouse storage in various industries. Larger containers with volumes greater than 600 L typically have higher mechanical requirements and more complicated load-bearing design than smaller capacity containers.

The existing large containers generally have specifications such as 1200×1000×1000,1220×1220×1170 and so on, and the size is relative large. In order to facilitate to pick up goods inside the container, a small door is generally provided over the middle part of a side plate to further benefit the operation. However, the hinge connection of the side plate and the small door provided on the side plate of the existing large container is simple, which brings the side plate provided with a small door to a certain of loss in intensity while the small door provided on the side plate facilitate to take goods. When the small door on the side plate is opened, the anti-deformation ability of the whole side plate is weaken. As a consequence, the side plates of the container are more liable to bulge outward toward the outer edge of the box when the box has a full load. Such deformation will not only lead to the safety hazard of the production itself, but also in transportation lead to failure of loading a certain number of containers into the cargotainers with fixed dimension, for the gap between containers is narrowed or even does not exist upon loading. As disclosed in the published patent WO201001456, a small door is provided on the side plate of the container, and for the small door is connected to side plate only via a guide of the small door and the side plate, the connection structure is simple while the thickness of the small door is thin and the intensity of the small door is weak relative to the wall of the side plate, these two factors cause the small door not only fail to limit the upper stack container which brings security risks, but also increase the arranged mutual gap between the side plates of containers which indirectly increase the storage cost, due to tension applied on the side plate by the goods is liable to deform the side plates upon loading goods by the small door and the deformation results in the limitation failure of the side plates stack. Second, the substantially rectangular small door is arranged on the side plate, and its corresponding parts of the side plate adjacent to the small door are relatively isolated parts, which have a deeper longitudinal length and a narrower horizontal length, and thus the bending resistance ability and anti-pressure ability of these parts are so weak as to be easily deformed or broken in use, which increases the loss of products therefore directly increasing product maintenance cost. In addition, the substantially rectangular small door structure is provided on the side plate, the meshing link of the side plate and the small door is substantially vertical (i.e., the meshing is substantially along the same vertical line). Such arrangement is easy to cause that after the inner wall of small door bears the tension extruded outward by goods, the small door will rotate and deform along the common meshing vertical line (the middle part of the small door will deform and bulge relative to both ends). Furthermore, there exists tolerance gap of meshing between the small door and side plate, which make the deformation of both the small door and side plate part superimposed, resulting in the tendency of the small door more obvious. These factors likewise increase the breakage of the side plate and the small door, and meanwhile increase the logistics and warehousing costs, which result in significant wastage.

SUMMARY

The object of the present invention is to provide a foldable container to solve the above problems in the prior art.

To achieve the above object, according to an aspect of the invention, a foldable container is provided, comprising a base, side plates connected to the base and a small door provided on the side plates, wherein the small door at least comprises a first part having a width gradually reducing from an upper end to a lower end, and first meshing portions are provided on left end wall and right end wall of the first part, and first meshing structures are provided on the side plates to cooperate with the first meshing portions.

Preferably, projection of the first part is trapezoidal, wherein projection of two end walls of the first part is waist of the trapezoidal.

Preferably, the first meshing portions integrally extends outward from end wall of the first part, and comprises a first vertical block, a second vertical block and horizontal block, wherein the first vertical block and the horizontal block integrally extends outward from the end wall of the first part, and the second vertical block is perpendicular to both the first vertical block and the horizontal block.

Preferably, the first vertical block, the second vertical block and the horizontal block are formed integrally.

Preferably, the small door further comprises a second part, and the width of the second part is wider than the width of the first part, and a second meshing portion is provided on the second part, and a second meshing structure is provided on the side plate to cooperate with the second meshing portion.

Preferably, the first part is an upper portion of the small door, and the second part is a lower portion of the small door.

Preferably, the second meshing portion is provided on the bottom and/or end wall of the second part.

Preferably, the small door further comprises a third part, and width of the third part is wider than width of the second part, and a meshing portion is provided on the third part.

Preferably, the width of the second part is 1.2~1.5 times the width of the first part.

Preferably, the small door and the side plates have smooth flat outer surfaces.

Preferably, height of the first part is 1~59 times height of the second part.

Preferably, the height of the first part is 1~11 times that of the second part.

Preferably, a stiffener is provided in the second part.

Preferably, width of stiffener is equal to width of the second part.

Preferably, the stiffener is made of steel pipe and aluminum profile.

Preferably, the second meshing portion comprises a protruding portion, which integrally extends downward from the bottom of the second part, and the second meshing structure comprises a recess, and the protruding portion is housed in the recess.

Preferably, the second meshing portion comprises a protruding portion and a protruding block, wherein the protruding portion integrally extends downward from the bottom of the second part, and the protruding block integrally extends outward from both sides of the protruding portion, and is integrally connected with the bottom of the first part, and the second meshing structure comprises a partition plate and a cavity separated by the partition plate, and a groove is provided on the middle portion of the partition plate, and the groove is housed in the recess, and the cavity is used to house the protruding block.

Preferably, the second meshing portion comprises multiple protruding blocks, which integrally extends downward from the bottom of the second part, and a groove is provided on the protruding blocks, and the grooves of the protruding blocks lie on one straight line, and the first meshing structure comprises a recess, and a partition plate is provided on the middle portion of each of the recess, and the partition plate is used to house the groove.

Preferably, the second meshing portion and the first meshing portion satisfy the following relationship: when the small door is projected to the plane which are parallel to the largest two sides of the small door, the projected area of the second meshing portion is larger than that of the projected area of the first meshing portion.

Preferably, when the small door is in the closed state, there exists even gap between the small door and the side plates.

Preferably, the side plates comprise a pair of opposite long side plates and a pair of opposite short side plates, and the small door is provided on one of the short side plates.

Preferably, a hinge is provided on the bottom of the small door, and the small door connects the side plate by the hinge.

According to another aspect of the invention, a foldable container is further provided, comprising a base, side plates connected to the base and a small door provided on the side plates, wherein the small door comprises a first part and a second part, and the first part is lower portion of the small door, and the second part is upper portion of the small door, and width of the second part is wider than width of the first part, and projection of the first part is trapezoid, wherein the projection of two end walls of the first part is waist of the trapezoid; a first meshing portion is provided on the bottom and/or end walls of the first part, and a second meshing portion is provided on the second part; and a first meshing structure to cooperate with a first meshing portion and a second meshing structure to cooperate with a second meshing portion are respectively provided on the side plates.

The container of the present invention maximizes the integrity of the upper end of the side plate, by lengthening the relatively rigid body of the upper end the deformation of the small door due to tension force applied by the full load goods is minimized, so that the deformation of the side plates is limited by the whole container, effectively solving a series of loading difficulties of container caused by the deformation of the side plates. Upon using, the small door can be operated easily, and when the container overall has a full load, the outward deformation of the small door is small, thereby saving loading space on conveyance or stacking space of the container.

DETAILED DESCRIPTION OF EMBODIMENTS

Figure 1:
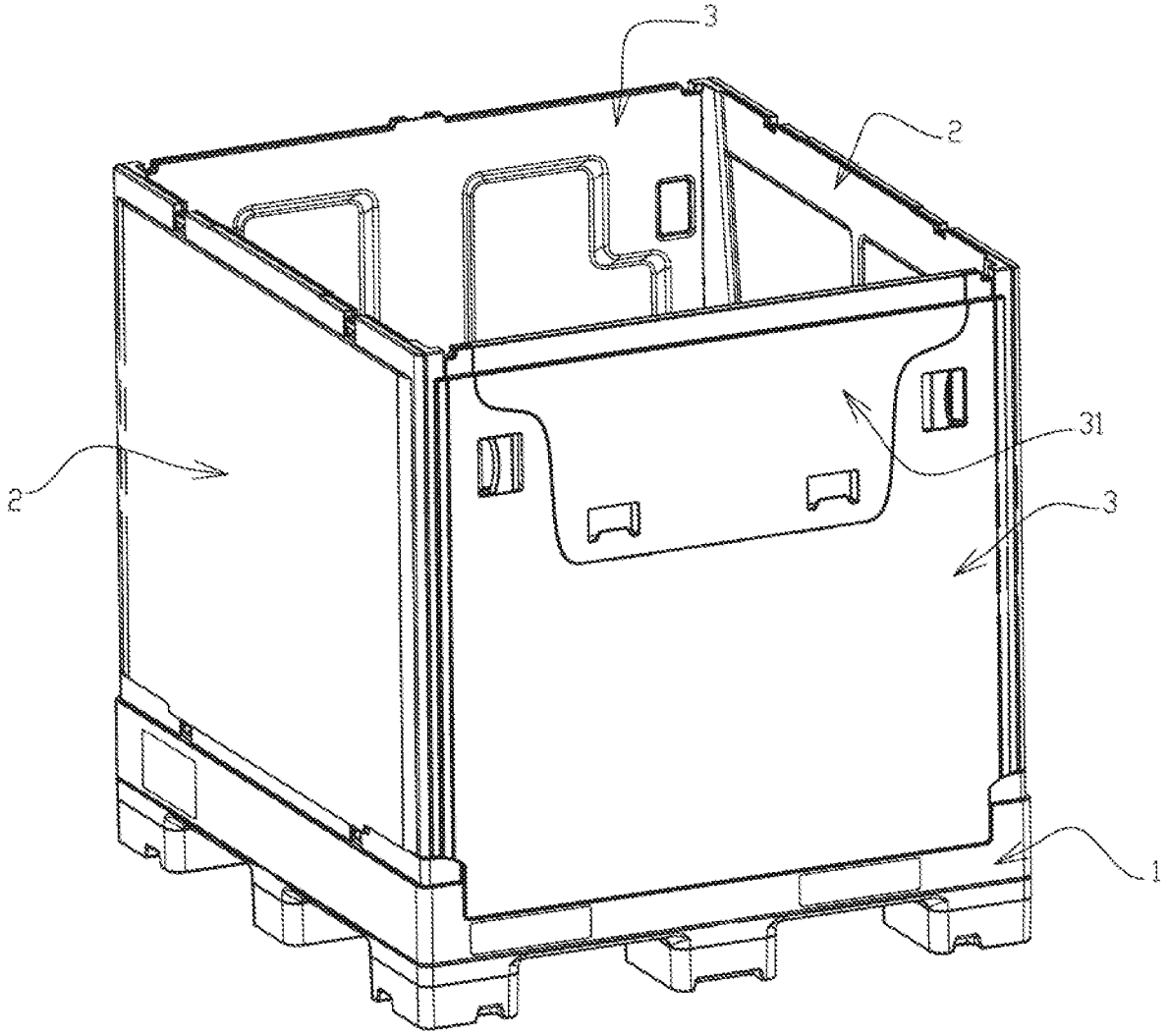
FIG. 1 is a perspective view of a foldable container according to an embodiment of the present invention, wherein the small door is in closed state.

The preferred embodiments of the present invention will be described in detail below with reference to the accompanying drawings in order to understand the purpose, features and advantages of the present invention more clearly. It should be understood that the embodiments shown in the drawings are not intended to limit the scope of the present invention, but merely illustrate the spirit of the technical solution of the present invention.

Term Description

In the present invention, both ends of the side plate refer to left and right ends when the side plate is in an upright position. Both ends of the small door refer to the left end and right end when the small door is in the closed state.

In the present invention, the trapezoid includes a case in which rounded corners are formed at the connection of the respective sides of the trapezoid and the case where both sides of the trapezoid are curved.

The orthographic projection in the present invention refers to the projection that the small door is projected onto a plane parallel to its two sides have the largest area.

Both ends in the present invention refer to left end and right end, unless otherwise specified.

The foldable container of the present invention generally comprises a base, side plates and a small door. The side plates are connected to the base. The small door is provided on the side plates. The small door at least comprises a first part, wherein the width of the first part gradually reduces from the upper end to the lower end, and first meshing portions are provided on the left end wall and the right end wall of the first part, and first meshing structure matching the first meshing portions are provided on the side plates.

One embodiment of the present invention is described below with reference to FIGS. 1-9.

Figure 2:
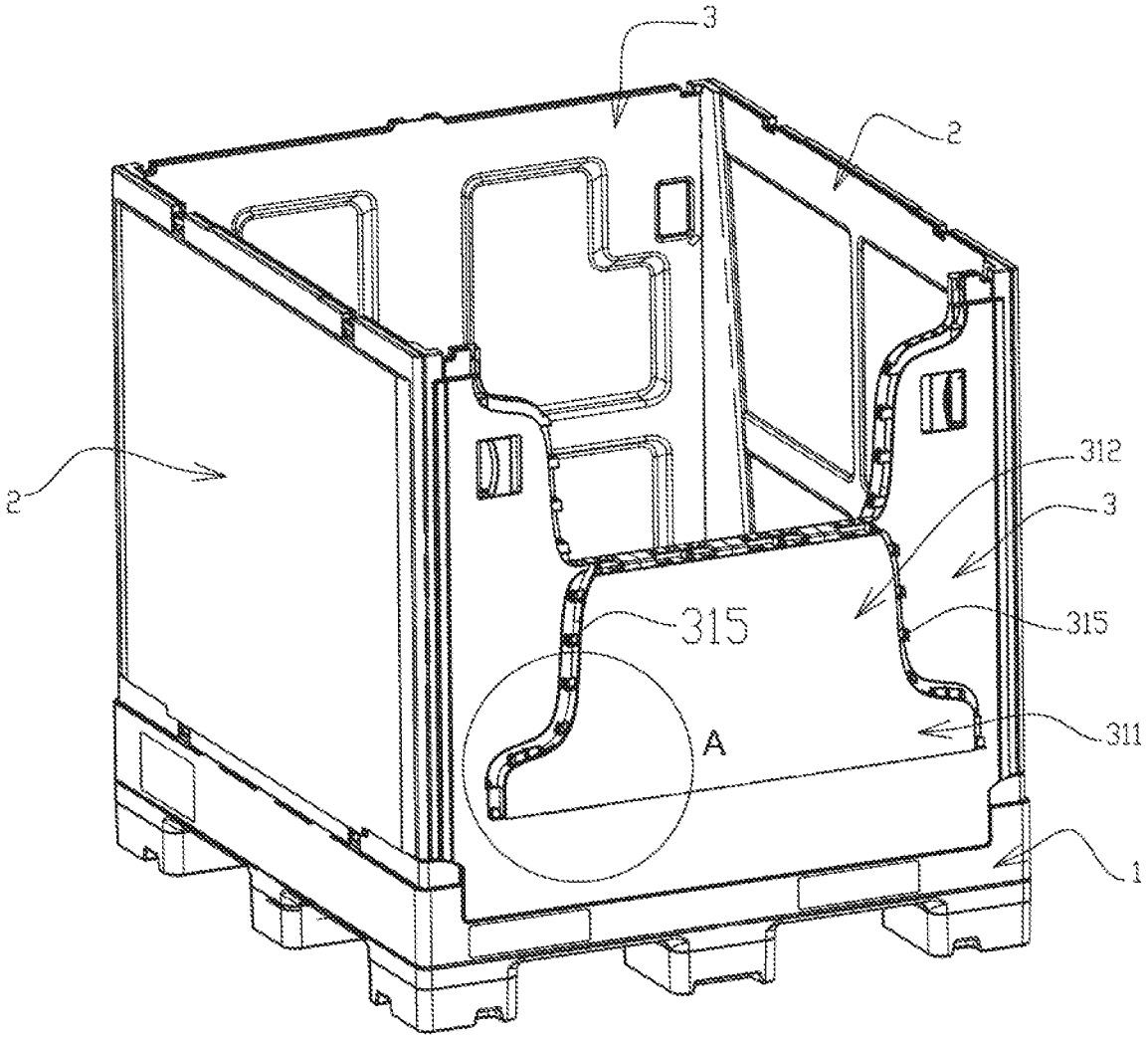
FIG. 2 is a perspective view of a foldable container according to an embodiment of the present invention, wherein the small door is in open state.
Figure 3:
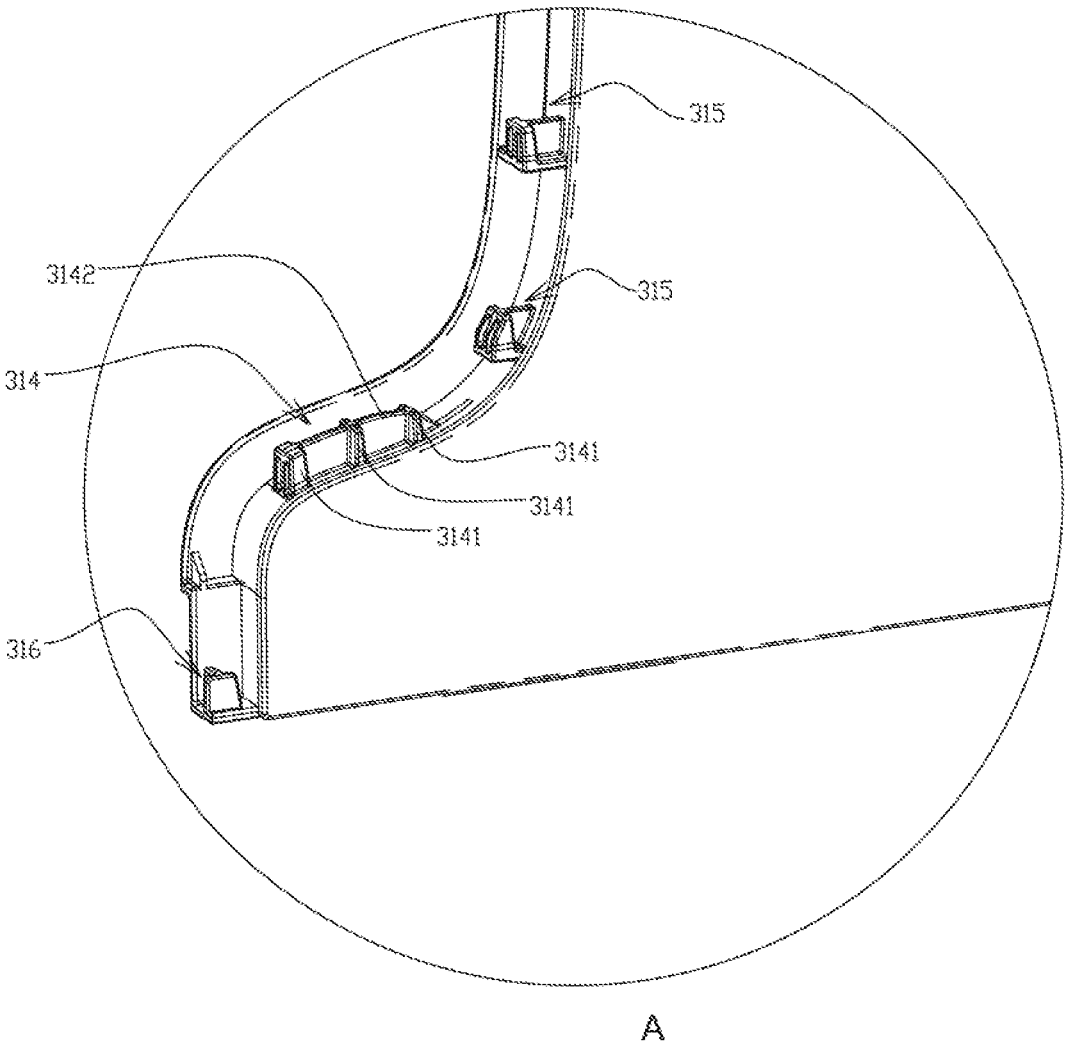
FIG. 3 is an enlarged view of part A in FIG. 2.

FIG. 1 is a perspective view of a foldable container 100 of the present invention, wherein the small door is in closed state. FIG. 2 is a perspective view of a foldable container 100 of the present invention, wherein the small door is in open state, and FIG. 3 is an enlarged view of part A in FIG. 2. As shown in FIGS. 1-3, the foldable container 100 comprises a base 1, a pair of side plates 2 and a pair of side plates 3, wherein side plates 2 are long side plates, and side plates 3 are short side plates. A small door 31 is provided on one of the side plates 3.

The small door 31 comprises a first part 312 and a second part 311, and the second part 311 is the upper part of the small door 31 (i.e., the upper part when the small door is closed), the first part 312 is the lower part of the small door 32 (i.e., the lower part when the small door is closed). The width of the second part 311 is wider than that of the first part 312. Preferably, as shown in FIG. 4, the width d1 of the second part 311 is 1.2 to 1.5 times the width d2 of the first part 312.

Figure 4:
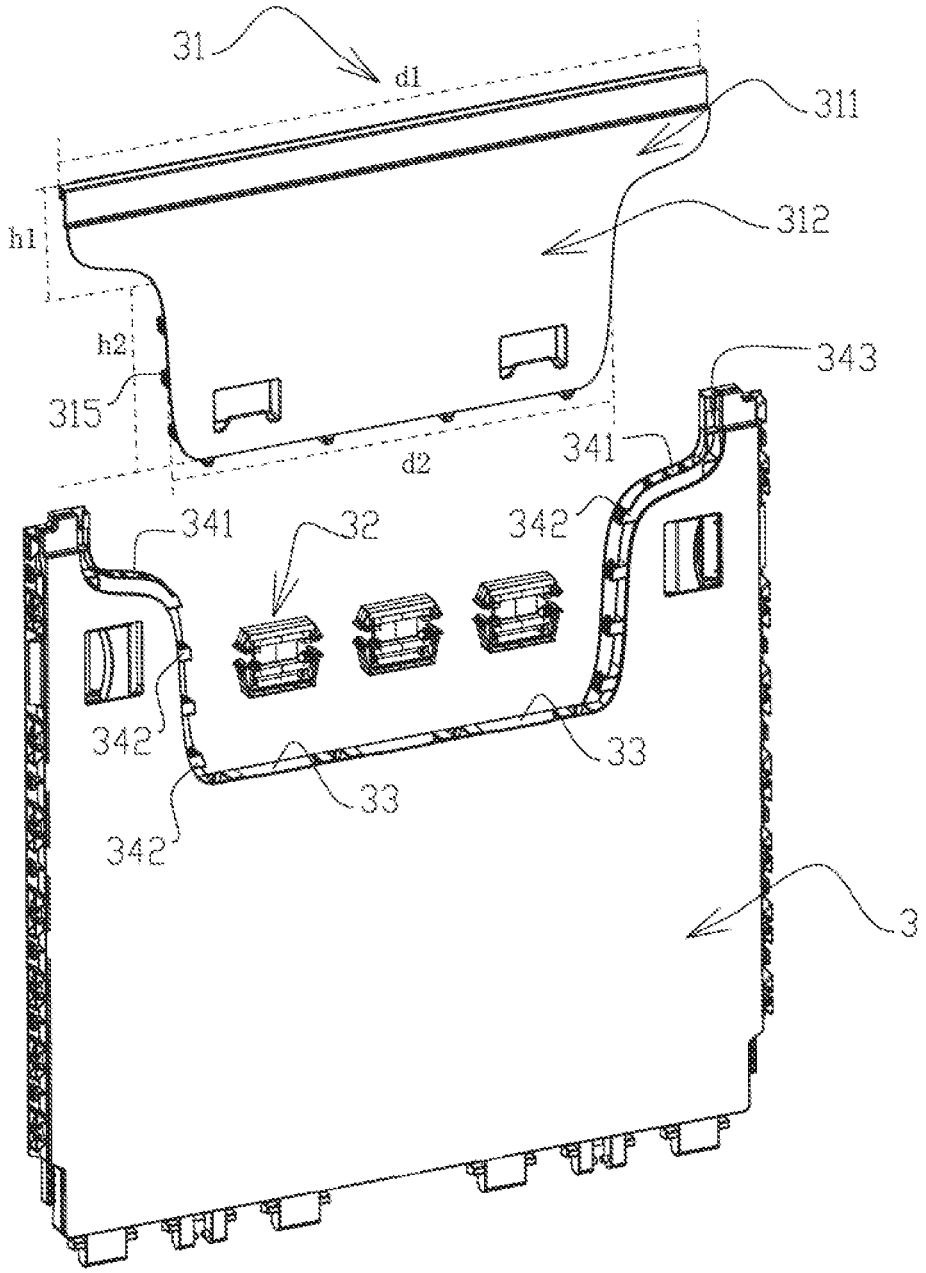
FIG. 4 is an exploded perspective view of side plates according to an embodiment of the present invention.
Figure 5:
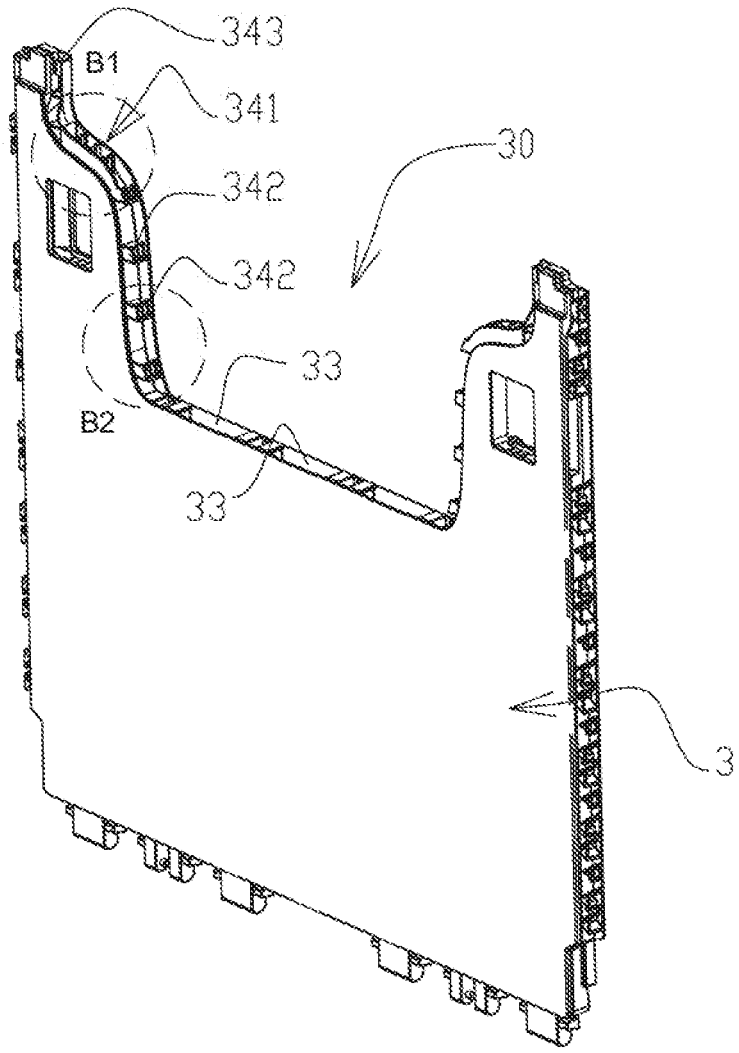
FIG. 5 is a perspective view of a side plate according to an embodiment of the present invention, wherein the small door has been removed.
Figure 6:
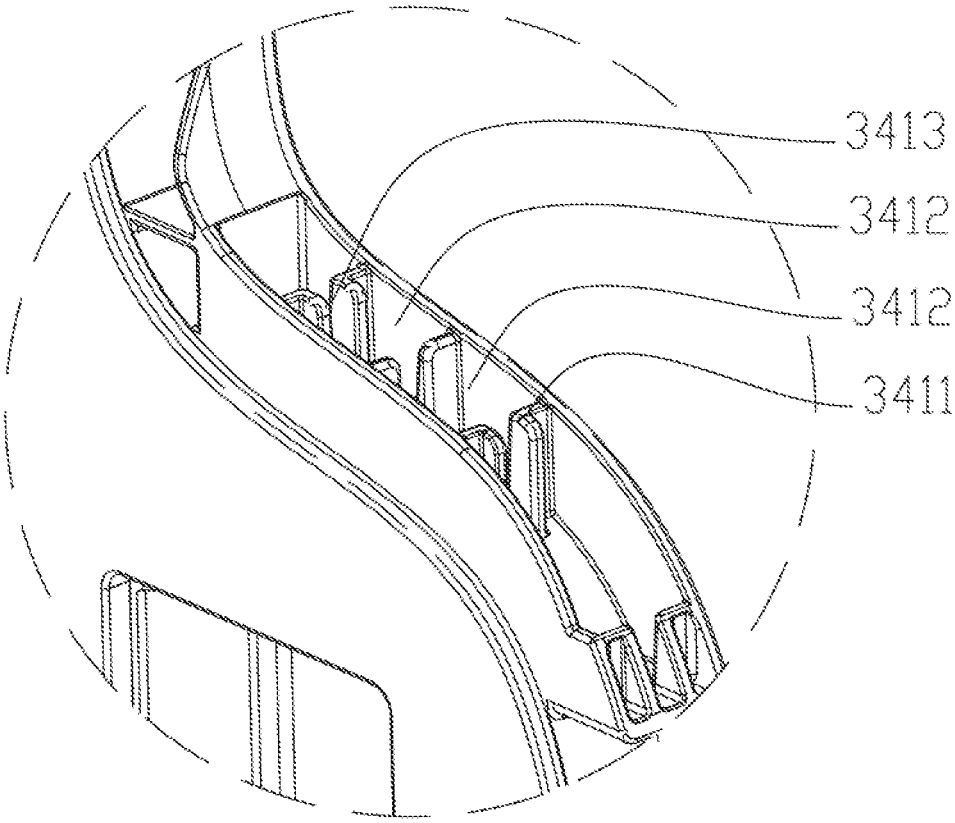
FIG. 6 is an enlarged view of part B1 in FIG. 5.

FIG. 4 is an exploded view of the side plate 3 with a small door 31. FIG. 5 is a perspective view of side plate 3, wherein the small door 31 has been removed. FIG. 6 is an enlarged view of part B in FIG. 5. As shown in FIGS. 4-6, a hinge 32 is provided on the bottom of the small door 31, and an opening 30 is provided on the side plate 3 corresponding to the small door. A hinge groove 33 is provided on the bottom of the opening 30. Part of the hinge 32 is provided in the hinge groove 33, and the small door 31 is connected to the side plate 3 by hinge 32, so that the small door 31 can rotate around hinge 32 relative to the side plate 3 to be opened or closed. The details of the hinge 33 please refer to CN patent CN102758572A, which is not described in detail herein.

In this embodiment, the small door 31 is T-shaped, and the first part 312 and the second part 311 are configured to be connected and transitioned by arc-shaped so that the sides of the first part 312 and the second part 311 form a curvilinear profile.

Back to FIGS. 2-3, either end of the small door 31 is provided with a first meshing portion 315 and a second meshing portion 314, wherein the second meshing portion 314 is provided on the bottom of the second part 311, and the first meshing portion 315 is provided on the left end wall and right end wall of the first part 312. A plurality of second meshing portion 314 may be provided on the bottom of the second part 311, and a plurality of first meshing portion 315 may be provided on the left end wall and right end wall of the first part 312. The width of the first part 312 gradually reduces from the upper end to the lower end, the first meshing portion 315 is provided on the left end wall and the right end wall of the first part 312.

In the present embodiment, due to the curved profile formed by the connection of the first part 312 and the second part 311, the second meshing portion 314 and the first meshing portion 315 are provided on the curved profile.

Although in the present embodiment, the second meshing portion 312 is provided on the bottom of the second part 311, it should be understood that the second meshing portion 314 may also be provided on the left end wall and right end wall of the second part 311.

As shown in FIG. 5, an opening 30 cooperating with the small door 31 is provided on the side plate 3. A plurality of hinge holes 33 are provided on the bottom of the opening 30, and part of the hinge 32 is mounted inside the hinge hole 32 and connect to the small door. The details about the hinge please refer to CN 102758572A, which will not be described in detail herein.

However, those skilled in the art should understand that in addition to the hinge disclosed in above patent CN 102758572A, the foldable container of the present invention may adopt other forms of hinges as long as it is ensured that when the small door and the side plates are connected by the hinge, the small door is opened or closed by pulling up the small door. Any hinge that can achieve such function may be suitable for the foldable container. Of course, the hinge disclosed in patent CN102758572A can be used with the first meshing portion and the second meshing portion of the present invention to further achieve the purpose of the present invention.

Both sides of the opening 30 are provided with a first meshing structure 342 and a second meshing structure 341, wherein the second meshing structure 341 cooperates with the second meshing portion 314, and the first meshing structure 342 cooperates with the first meshing portion 315. In present embodiment, in order to cooperate with the curved profile on both ends of the small door 31, both sides of the opening 30 are formed with a shape cooperating with the curved profile of the small door 31.

Back to FIG. 3, as shown in FIG. 3, in the present embodiment, a third meshing portion 316 is provided on the left end wall and the right end wall of the second part 311. Correspondingly, as shown in FIG. 5, a third meshing structure 343 is provided on the upper portion of the side plates 3 on both sides of the opening 30, and the third meshing portion 316 cooperates with the third meshing structure 343.

Back to FIG. 1, in the present embodiment, when the small door 31 is in closed state, the second part 311 of the small door 31 extends to both ends of the side plate 3 to the utmost extent, so as to ensure enough strength when the small door 31 is in closed sate.

Back to FIG. 3, the second meshing portion 314 comprises a protruding portion 3142 and a protruding block 3141, wherein the protruding portion 3142 integrally extends downward from the bottom of the second part 31 (extending in the upward direction shown in FIG. 3), and is parallel to the outer side or inner side of the small door 31. The protruding block 3141 integrally extends outward from both sides of the protruding portion 3142, and are integrally connected with the bottom of the second part 31. In the present embodiment, three protruding block 3141 integrally extends outward from both sides of the protruding portion 3142, so that the protruding portion 3142 and the protruding block 3141 are shaped similar as Chinese character "工" shaped.

Back to FIG. 6, corresponding to the second meshing portion 314, the second meshing structure 341 comprises three partition plates 3411, which separate three cavities 3412. A groove 3413 is further provided in the middle portion of each partition plates 3413, the groove 3413 cooperates with the protruding portion 3141 in the second meshing portion 314 and accommodate the protruding portion 3141.

Figure 7:
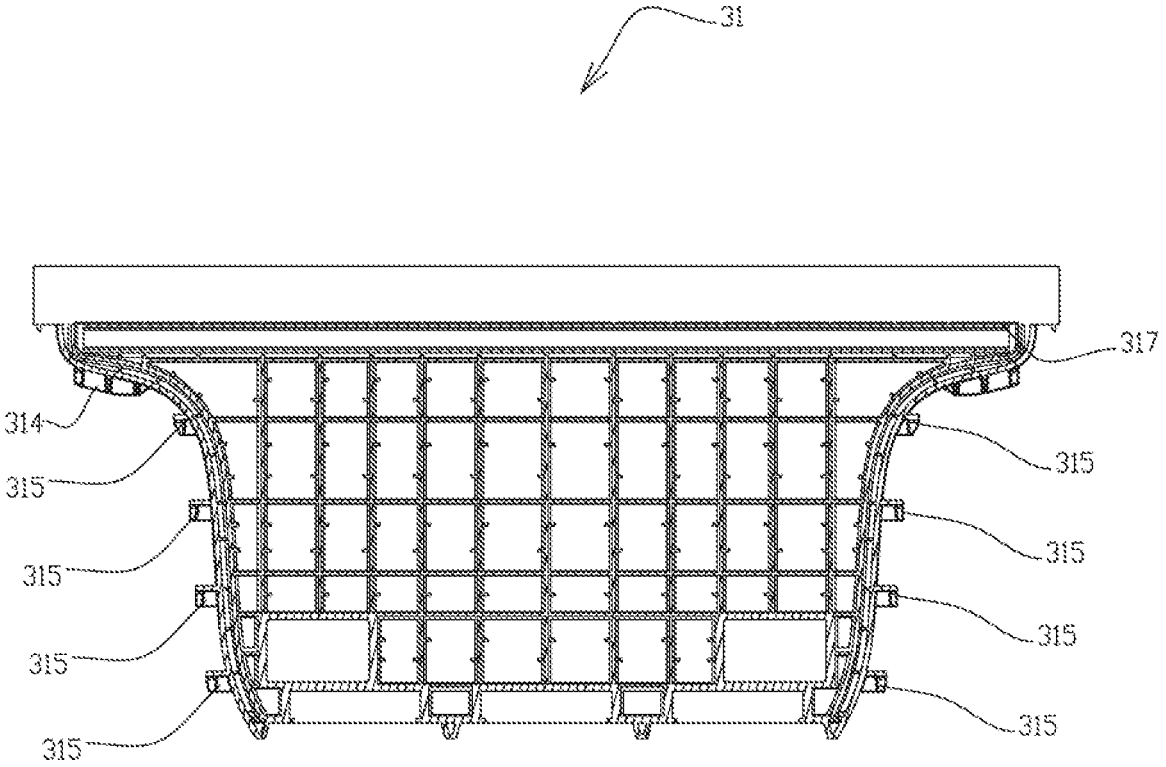
FIG. 7 is a sectional view of a side plate according to an embodiment of the present invention.

FIG. 7 is a sectional view of the small door 31 of the present embodiment. As shown in FIG. 7, in the present embodiment, a stiffener 317 is further provided in the second part 311. Preferably, the stiffener 317 is made of a reinforcing material, such as a steel pipe or an aluminum profile. The stiffener 317 further strengthens the intensity of the small door 31, which ensures the intensity of small door 31 when the small door 31 is extruded by the goods in the container.

Figure 8:
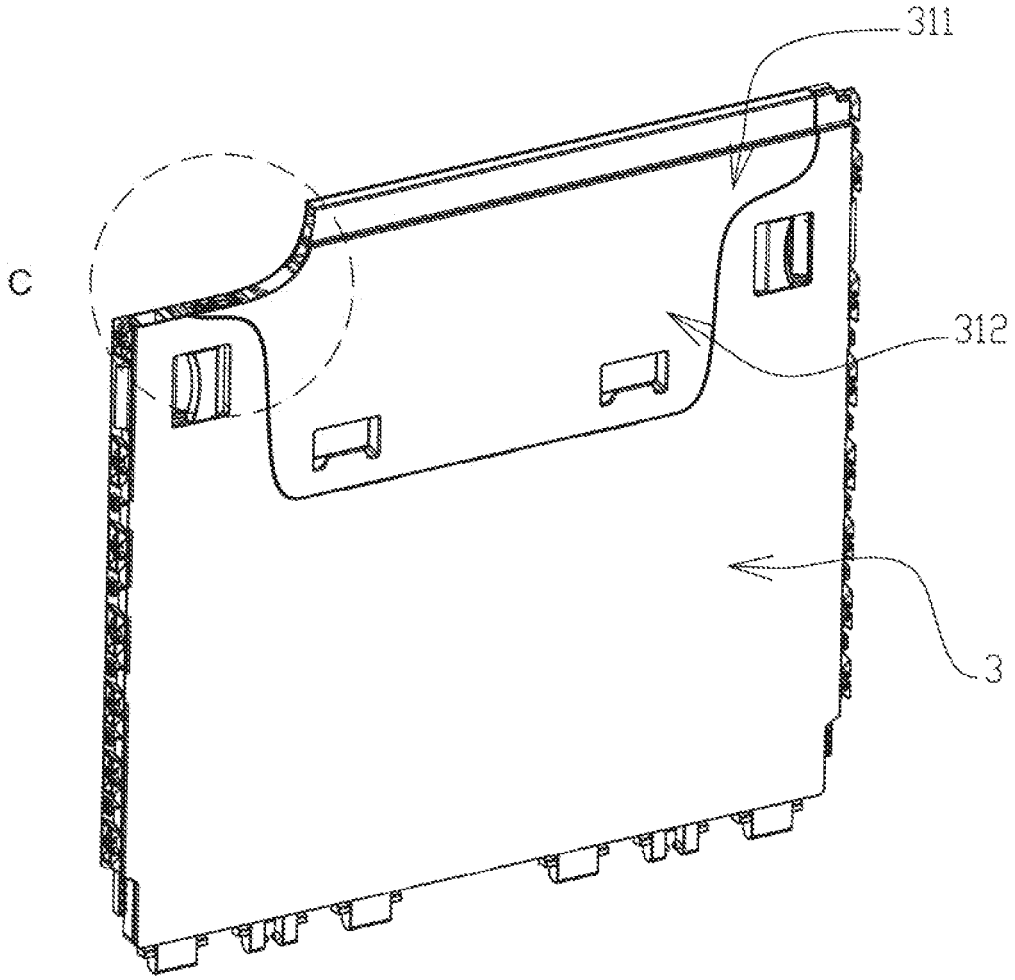
FIG. 8 is a sectional view of a side plate according to an embodiment of the present invention, wherein the small door is in closed state.
Figure 9:
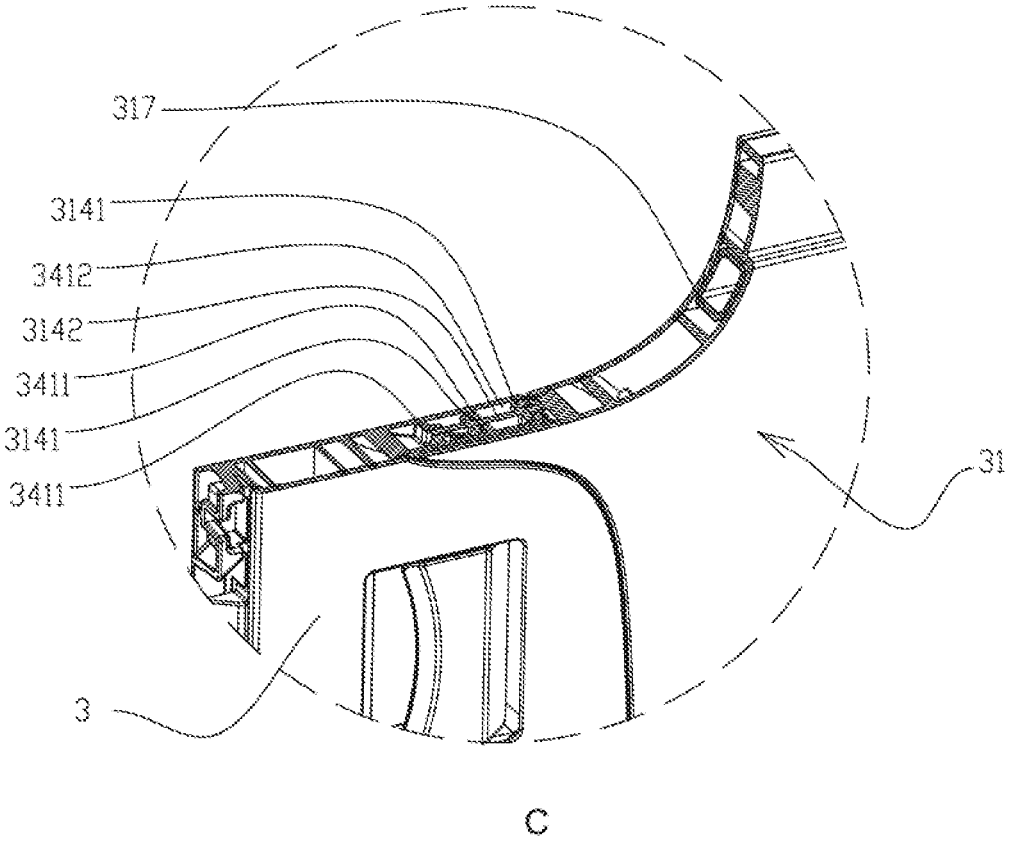
FIG. 9 is an enlarged view of part C in FIG. 8.

FIG. 8 is a partial sectional view of the side plate 3 when the small door is in closed sate, and FIG. 9 is an enlarged view of part C in FIG. 8. As shown in FIGS. 8-9, the protruding portion 3142 penetrates through multiple grooves 3413, and the protruding portion 3142 is able to slide in the groove 3413, and the protruding block 3141 is able to slide in the cavity 3412 and is limited by two adjacent partition plates 3411 when the small door is changed from the closed state to the open state or from the open state to the closed state.

Back to FIG. 3, the first meshing portion 315 integrally extends outward from the end wall of the first part 312, and comprises a first vertical block 3151, a second vertical block 3152 and a horizontal block 3153, wherein two holes 3154 are provided on the second vertical block 3152. Wherein, the first vertical block 3151 and the horizontal block 3153 integrally extend toward outer from the end wall of the first part 312, and the first vertical block 3151 is perpendicular to the horizontal block 3153, and the second vertical block 3152 is perpendicular to both the first vertical block 3151 and the horizontal block 3153. The first vertical block 3151, the second vertical block 3152 and the horizontal block 3153 are formed integrally.

Figure 6A:
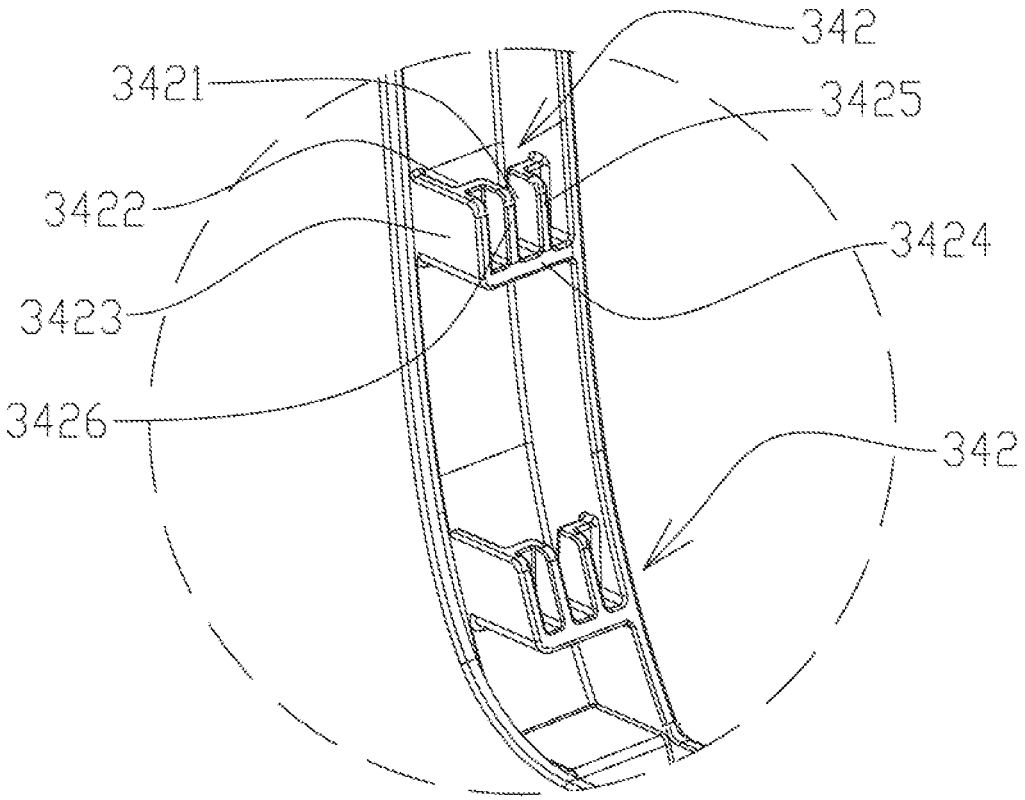
FIG. 6A is an enlarged view of part B2 in FIG. 5.

FIG. 6A is an enlarged view of part B2 in FIG. 5. Now the first meshing structure 342 cooperating with the first meshing portion 315 will be described with reference to the FIG. 6A. As shown in FIG. 6A, the first meshing structure 342 is provided on two sides of the opening 30, and comprises a partition plate 3423, a partition plate 3424, a partition plate 3425 and a partition plate 3426, wherein the partition plate 3423 and the partition plate 3424 integrally extends from one side of the opening 30, and defines a fixing groove 3422 and a straight 3412 with the partition plate 3425 and the partition plate 3426. When the small door 31 is in closed state, the first vertical block 3151 is housed in the straight groove 3421, and the second vertical block 3152 is housed in the fixing groove 3422 so that the first meshing portion 315 closely cooperates with the first meshing structure 342.

Back to FIGS. 1 and 2, when it is necessary to close the small door 31, the small door 31 is turned upward from the state shown in FIG. 2 to be substantially horizontal to the body of the side plate, then pressed downward from the upper end of the small door so that the second meshing portion and the first meshing portion of the small door fall into the second meshing structure and the first meshing structure of the side plate 3 to complete the closing operation of the small door, and versa the small door is opened.

In the present embodiment, due to both sides of the small door 31 are configured as curved profile, the second meshing portion 314 and the first meshing portion 315 are provided on the curved profile so that when the small door is in closed state, and the second meshing portion 314 and the first meshing portion 315 respectively engage with the second meshing structure 341 and the first meshing structure 342, the connection line between the first meshing portion 315 and the first meshing structure 342 also forms a curve line. Thus, when the small door 31 is extruded by the goods in the container 3, the deformation of the small door 31 rotates around multiple rotation axes, and these rotation axes do not lie in one straight line so that the small door 31 is less susceptible to damage due to the extrusion of the goods in the container 3. At the same time, since the stiffener is provided in the second part 31, the intensity of the small door is greatly enhanced. And since the both ends of the second part 31 extends to the both ends of the side plate 3 to the utmost extent, the intensity of the side plate and the small door is further improved.

In the present embodiment, to further ensure the meshing strength of the small door and the side plate, the second meshing portion 314 and the first meshing portion 315 provided on the second part 31 further satisfy the following relationship: the projected area of the first meshing portion is smaller than that of the second meshing portion, so as to better ensure the meshing strength of the second meshing portion 314 and the second meshing structure 341.

In the present embodiment, the shapes of the second part 311 and the first part 312 are all approximate trapezoidal shapes. However, those skilled in the art should understand that only the second part 311 or the first part 312 may be disposed in an approximately trapezoidal shape.

Another embodiment of the container of the present embodiment will be described with reference to FIGS. 10-17.

Figure 10:
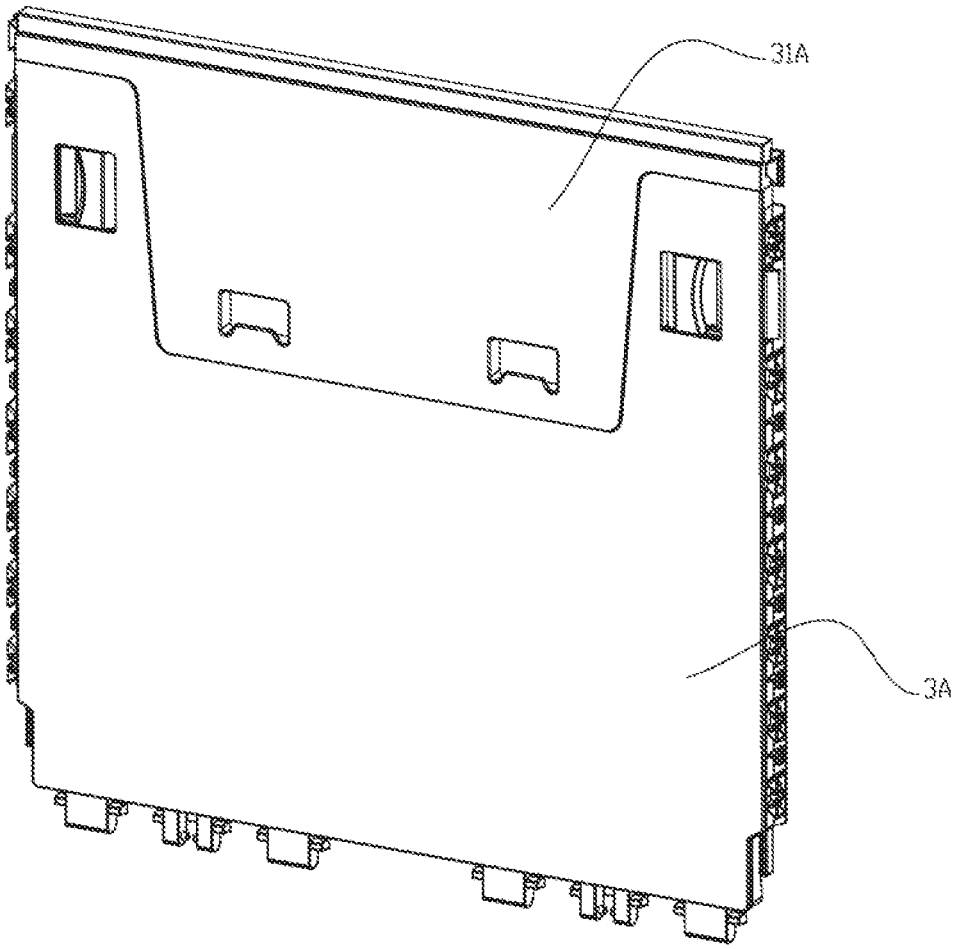
FIG. 10 is a perspective view of a side plate according to another embodiment of the present invention.
Figure 11:
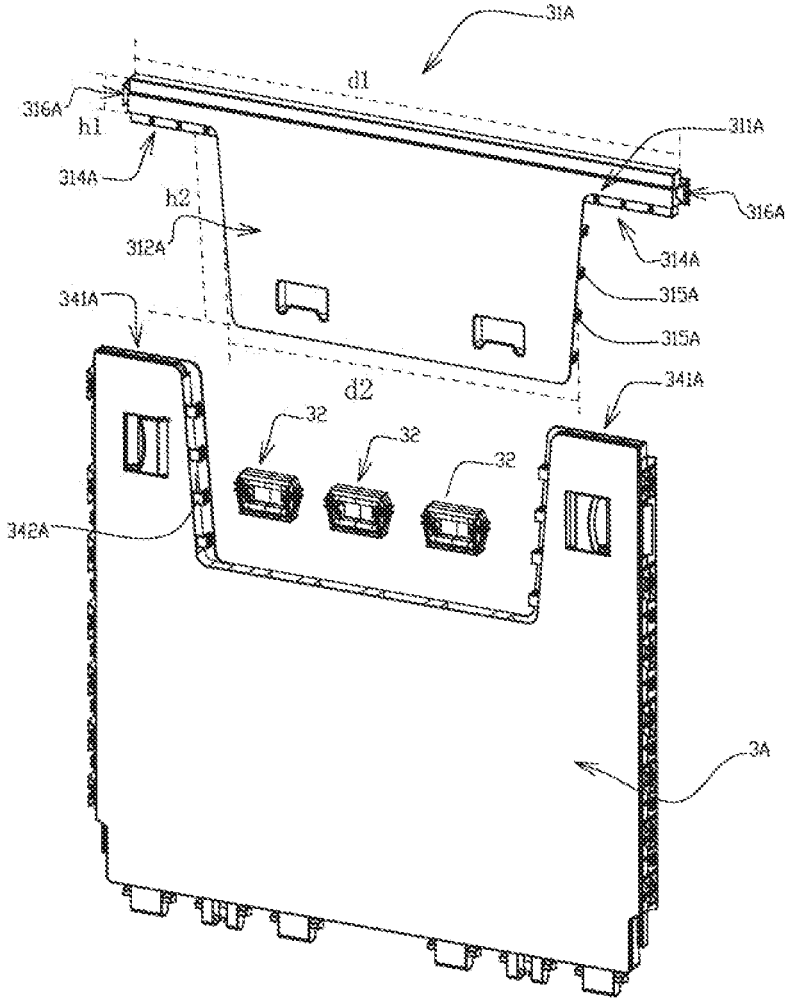
FIG. 11 is an exploded perspective view of a side plate according to another embodiment of the present invention.

FIG. 10 is a perspective view of the side plate 3A of the container according to anther embodiment of present invention. FIG. 11 is an exploded view of the side plate 3A of the container according to another embodiment of the present invention. As shown in FIGS. 10-11, a small door 31A is provided on the side plate 3A, and the small door 31A comprises a first part 312A and a second part 311A, and the second part 311A is the upper portion of the small door, and the first part 312A is the lower portion of the small door. The second meshing portion 314A is provided on the bottom of the second part 311A, and the first meshing portion 315A is provided on the left end wall and the right end wall of the first part 312A. A hinge 33 is provided on the bottom of the small door 31A (i.e., the bottom of the first part 312A), and the small door 31A is connected to the side plate 3A by the hinge 33. The details of the hinge please refer to CN102758572A, which will not be described herein.

Figure 12:
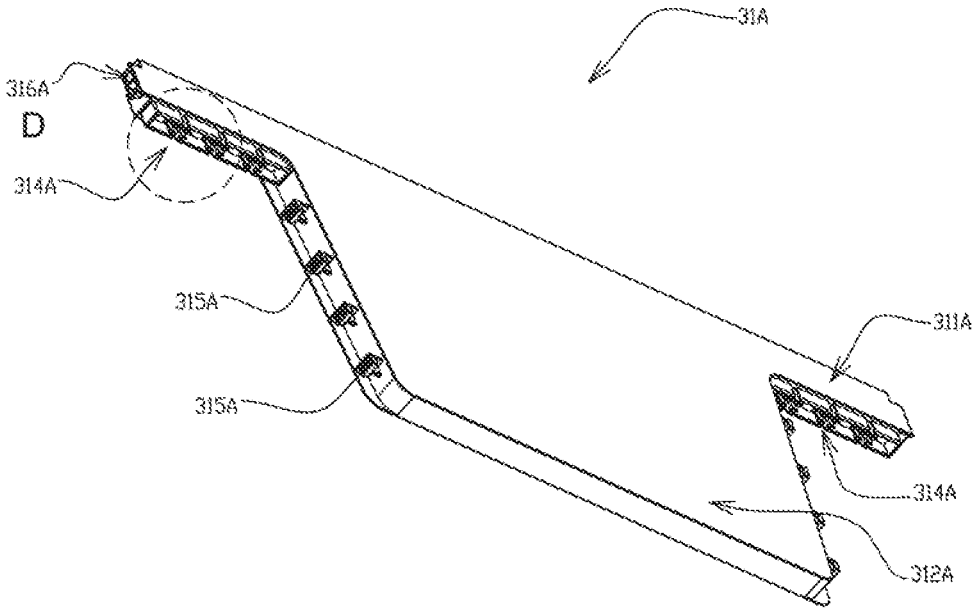
FIG. 12 is a perspective view of a small door according to another embodiment of the present invention.
Figure 13:
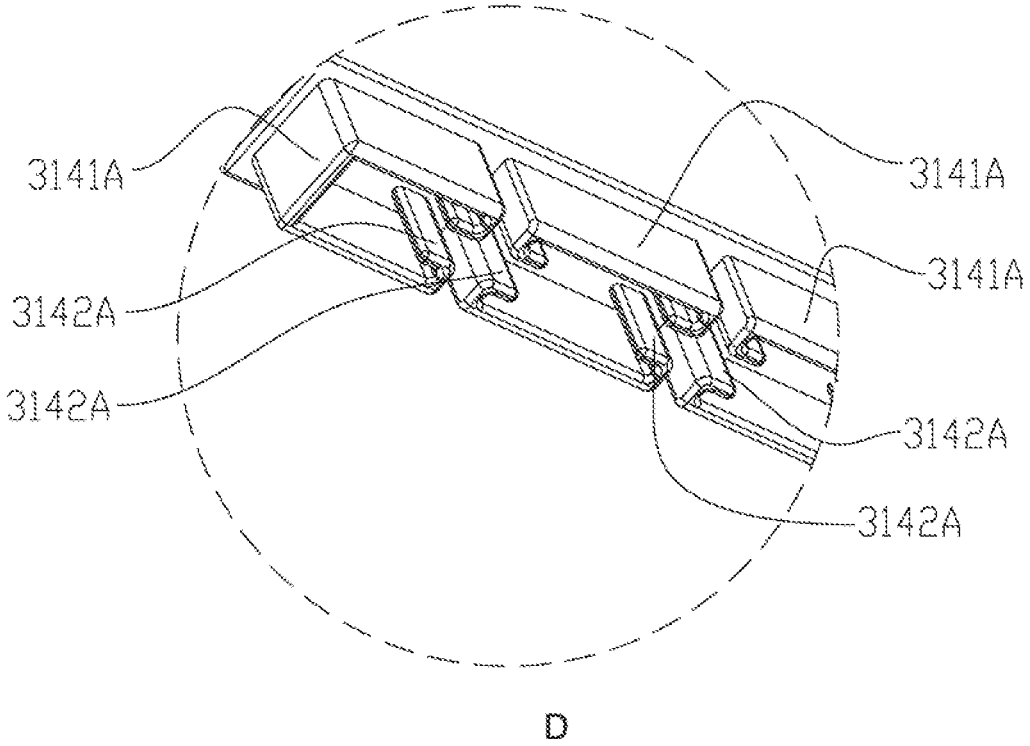
FIG. 13 is an enlarged view of part D in FIG. 12.

FIG. 12 is a perspective view of the small door 31A, and FIG. 13 is an enlarged view of the part D in the FIG. 12. As shown in FIGS. 12-13, the second meshing portion 314A comprises three protruding block 3141A, which integrally extends downward from the bottom of the second part 314A. A groove 3142A is provided on the protruding block 3141A, and the grooves 3142A of the three protruding block 314A lie on one straight line. The third meshing portion 316A is provided on the side of the second part 311A, correspondingly, a meshing structure corresponding to the third meshing portion 316A is provided on the adjacent side plate of the side plate 3A, so that the strength is significantly enhanced when the small door 31 is in the closed state.

Figure 14:
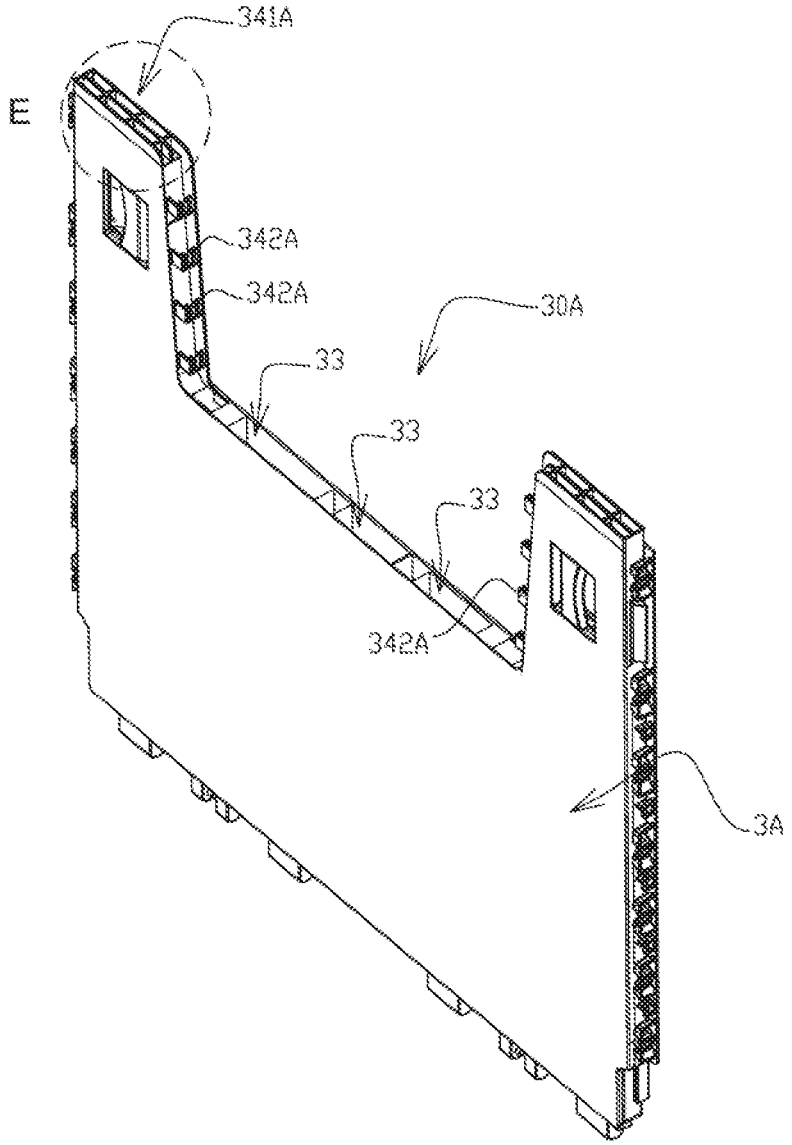
FIG. 14 is a perspective view of a side plate according to another embodiment of the present invention, wherein the small door has been removed.
Figure 15:
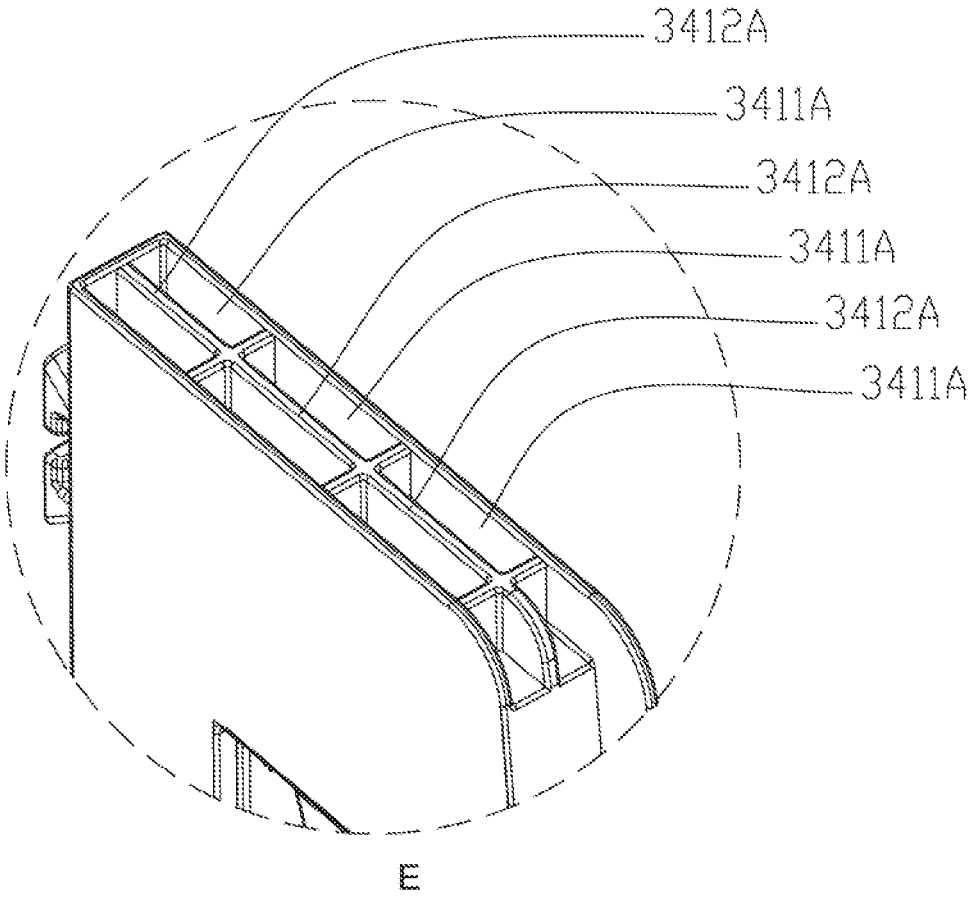
FIG. 15 is an enlarged view of part E in FIG. 14.

FIG. 14 is a perspective view of the side plate 3A, wherein the small door 31 is removed. FIG. 15 is an enlarged view of the part E in FIG. 14. As shown in FIGS. 14-15, an opening 30A is provided on the side plate 3A to cooperate with the small door 31A. A hinge hole 33 cooperating with the hinge 32 is provided on the bottom of the opening 30A. A meshing structure 342A cooperating with the first meshing portion 315A is provided on the both sides of the opening 30A, and the second meshing structure 341A is provided on the upper portion of the side plate 3A (on the upper portion of the side plate 3A on both sides of the opening 30A), and the second meshing structure 341A cooperates with the second meshing portion 314A. The second meshing structure 341A comprises three recesses 3411A, and a partition plate 3412A is provided on the middle portion of each of the recesses. Partition plates 3412 A of the three recesses 3411A lie on one straight line.

Figure 16:
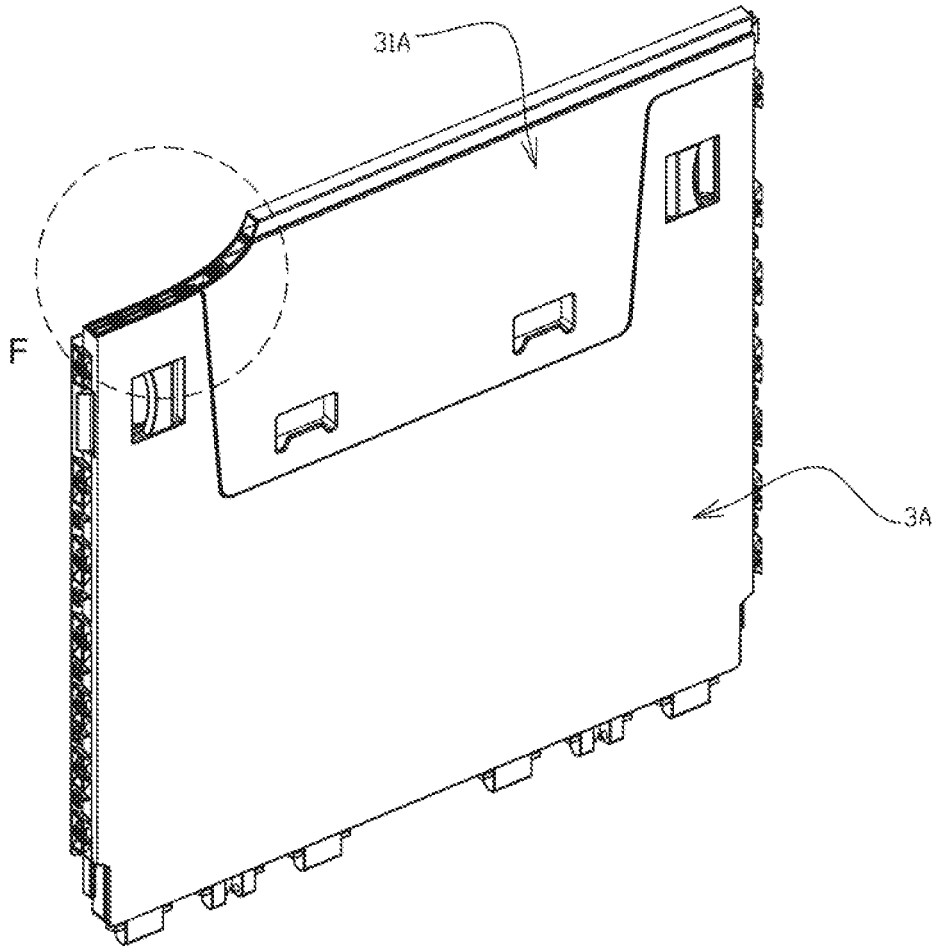
FIG. 16 is a sectional view of a side plate according to another embodiment of the present invention.
Figure 17:
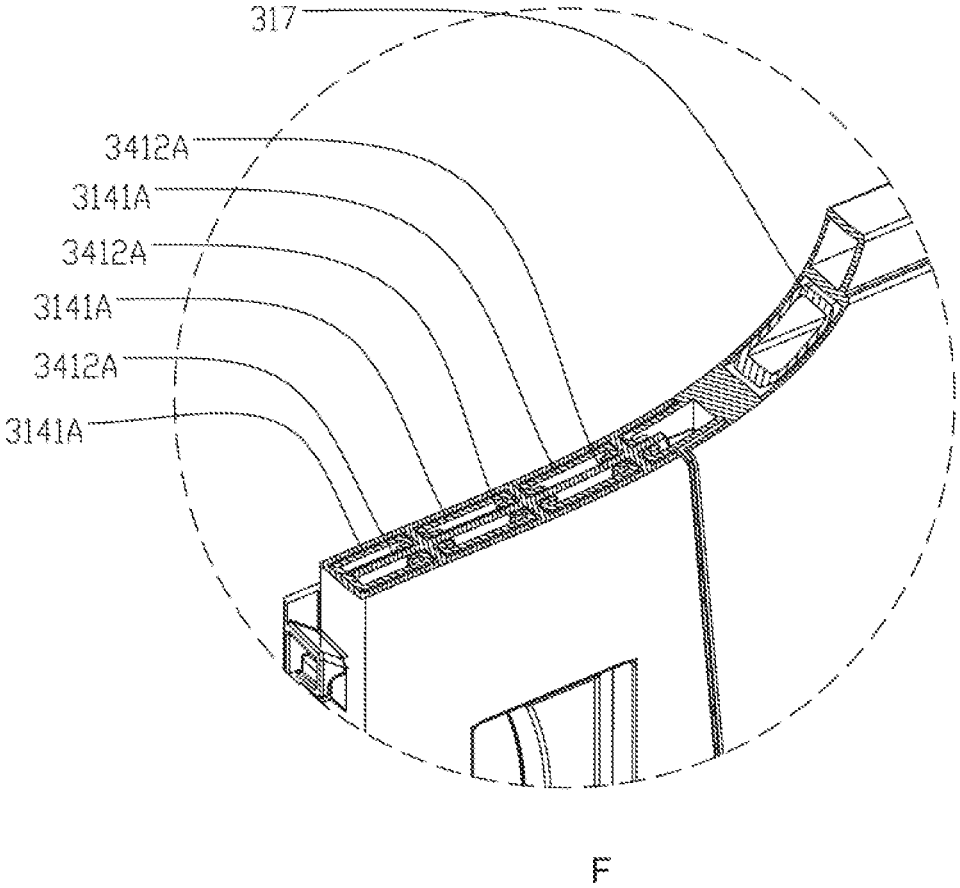
FIG. 17 is an enlarged view of part F in FIG. 16.

FIG. 16 is a partial sectional view of the side plate 3A. FIG. 17 is an enlarged view of the part F in FIG. 16. As shown in FIGS. 16-17, when the small door 31A is in the closed state, the protruding block 3141A is housed in the recesses 3411A and the partition plate 3412A is housed in the recesses 3142A.

The details about the first meshing portion 315A and the first meshing structure 342A please refer to the first meshing portion 315 and the first meshing structure 342, which will not be described in detail herein, In the present embodiment, compared with the previous embodiment, the small door is T-shaped, and the transitional portion from both ends of the second part 311A to the both ends of the first part 312A are steeper, less gentle than that of the first embodiment. The bottom of the second part 311A is approximately located on the straight line, and the both ends of the first part 312A are also approximately located on the straight line. Moreover, in the present embodiment, both ends of second part 314A of the small door 31A are not connected with the side plate 3A, but connected to the adjacent side plates of the side plate 3A.

Preferably, as shown in FIG. 11, the width d1 of the second part 311A is 1.2~1.5 times the width d2 of the first part 312A. In such a configuration, the strength of the first part and the second part can be ensured at the same time.

Although in the present embodiment, the second meshing portion 311 is provided on the small door 31, the second meshing structure 311A is provided on the small door 31A, those skilled in the art should understand the second meshing portion 311A may alternately be provided on the small door 31, and the second meshing portion 311 may be provided on the small door 31A, meanwhile, correspondingly the second meshing structure 341A is provided on the side plate 3 and the second meshing structure 341 is provided on the side plate 3A. Furthermore, those the skilled in the art should understand that the other form of the meshing portion may also be provided on the bottom of the second portion of the small door, and the second meshing portion and the first meshing portion may also be provided to have the same structure.

Although in above embodiment of the present invention, the small door comprises a second part and a first part, those skilled in the art can understand that the small door may also merely comprise a first part. In this case, since the width of the small door gradually reduces from the upper end to the lower end, the first meshing portions provided on the left end wall and the right end wall are not in a vertical line, so that when the small door is extruded by the goods in the foldable container, the axes around which the small door rotate to deform are not in a straight line, therefore the strength of the small door is greatly enhanced.

Of course the small door may alternately comprise a first part, a second part and a third part. In this case, the width of the second part is wider than that of the first part, and the width of the first part is wider than that of the third part. The meshing portions are respectively provided on the second part, the first part and the third part. The meshing structures cooperating with the meshing portions are provided on the side plate. These meshing portions and meshing structures may be the same structure, and the small door may also comprise a forth part, a fifth part, and so on.

In above two embodiments of the present invention, as a preferred way, as shown in FIG. 4 and FIG. 11, the height of the second part and the first part may satisfy the following relationship: that is, the height h1 of the second part is 1~59 times the height h2 of the first part. Preferably, the height of the first part is 1~11 times the height of the second part. In such a configuration, when the second part extends close to both ends of the side plate or the second part extends to connect with the adjacent side plates, the strength of the second part and the first part is ensured to satisfy the requirements.

It should be understood that although in the present invention, a first meshing portion, a second meshing portion and a third meshing portion are respectively provided on the small door, those skilled in the art should understand that the first meshing portion, the second meshing portion and the third meshing portion may be the same structure, or the first meshing portion has the same structure as the second meshing portion, or the first meshing portion has the same structure as the third meshing portion, or the second meshing portion has the same structure as the third meshing portion.

In the two embodiments described above, the shape of the first part of the small door is trapezoidal or approximately trapezoidal, but those skilled in the art should understand that the shape of the first part can be in other forms, such as the bottom of the first part is arc-shaped, and the hinge groove is provided on the arc-shaped bottom.

While the preferred embodiments of the present invention have been described in detail, it should be understood that various modifications or changes may be made to the present invention by those skilled in the art after reading the above teachings of the present invention. These equivalent forms also fall within the scope of the appended claims of the present application.

The invention claimed is:

1. A foldable container, comprising:
a base;
side plates connecting to the base; and
a small door provided on one of the side plates, the small door comprising:
a first part having a width gradually reducing from an upper end to a lower end, first meshing portions provided on a left end wall and a right end wall of the first part, and
a second part having a width wider than the widest width of the first part, a second meshing portion provided on the second part, wherein
first meshing structures are provided on the one of the side plates to cooperate with the first meshing portions, and
a second meshing structure is provided on the one of the side plates to cooperate with the second meshing portion.

2. The foldable container according to claim 1, wherein the second meshing portion is provided on bottom and/or end wall of the second part.

3. The foldable container according to claim 1, wherein the widest width of the second part is 1.2-1.5 times wider than the widest width of the first part.

4. The foldable container according to claim 1, wherein a stiffener is provided in the second part.

5. The foldable container according to claim 1, wherein the second meshing portion comprises a protruding portion, which integrally extends downward from a bottom of the second part, and the second meshing structure comprises a recess, and the protruding portion is housed in the recess.

6. The foldable container according to claim 1, wherein the small door includes sides, the sides including two largest sides based on area, the second meshing portion and the first meshing portions satisfy the following relationship: in a projection of the small door onto a plane that is parallel to each of the two largest sides of the small door an area of the second meshing portion is larger than an area of the one of the first meshing portions.

7. The foldable container according to claim 1, wherein the side plates comprise a pair of opposite long side plates and a pair of opposite short side plates, and the small door is provided on one of the short side plates.

8. The foldable container according to claim 1, wherein a hinge is provided on a bottom of the small door, and the small door connects the side plates by the hinge.

9. A foldable container, comprising:
a base;
side plates connected to the base; and a small door provided on one of the side plates, the small door comprising:

a first part located at a lower portion of the small door, and a second part located at an upper portion of the small door, and a width of the second part is wider than a width of the first part, and wherein the first part has a trapezoid shape with two lateral sides, two end walls of the first part forming the two lateral sides of the trapezoid shape, and a first meshing portion is provided on one of the two end walls of the first part, a second meshing portion is provided on a bottom and/or an end wall of the second part, and a first meshing structure to cooperate with the first meshing portion and a second meshing structure to cooperate with the second meshing portion are respectively provided on the one of the side plates.

* * * * *